United States Patent [19]

Marvosh

[11] Patent Number: 4,953,149

[45] **Date of Patent: * Aug. 28, 1990**

[54] TWO SPEED CLOCK FOR DAYLIGHT SAVING

[76] Inventor: Daniel Marvosh, 3085 Clarmeya La., Pasadena, Calif. 91107

[ * ] Notice: The portion of the term of this patent subsequent to Aug. 9, 2005 has been disclaimed.

[21] Appl. No.: 395,427

[22] Filed: Aug. 9, 1989

[51] Int. Cl.[5] ..... G04B 19/00

[52] U.S. Cl. ..... 368/223; 368/157; 368/228; 368/231

[58] Field of Search ..... 368/223–228, 368/229–231, 157, 185

[56] References Cited

U.S. PATENT DOCUMENTS 4,763,311 8/1988 Marvosh ..... 368/228

OTHER PUBLICATIONS

Letter to the Editor, Mensa Magazine, 3/86, A New Kind of Setting Time, Williams.

*Primary Examiner*—Bernard Roskoski

[57] ABSTRACT

A two-speed battery powered quartz daylight saving clock operating for a first six months' period beginning on the shortest day of the year at two and one-half seconds per hour fast (fast time) and then being adjustable to operate for a second six months' period beginning on the longest day of the year at two and one-half seconds per hour slow (slow time) to complete each annual cycle.

5 Claims, 1 Drawing Sheet

TWO SPEED CLOCK FOR DAYLIGHT SAVING

DESCRIPTION OF THE INVENTION

FIELD OF THE INVENTION

The present invention provides a means for time indicating devices, including battery/quartz powered wall clocks pocket watches, wrist watches, outdoor clocks and others, to save all available daylight all year by having our clocks timed by synchronizing with the earth's rotation on its 23½ degree tilt and moving on its orbit around the sun.

Quartz clocks are well known in the prior art and typically comprise a transmitter whose oscillating circuit is controlled by a quartz crystal. At the output end an alternating voltage with a frequency possessing a high degree of constancy is obtained. The output can be fed through frequency reducing circuits, or be supplied to a motor and thus be used to drive the hands of a normal clock via a drive shaft and suitable gearing.

All spring wound and weight powered time pieces have the built-in means for changing to fast or slow time. Electric clocks powered by synchronous motors will remain as they are without any change required.

One object of the present invention is to include in battery/quartz powered clocks a selective control to actuate the fast and slow time two times a year.

A further object of the present invention is to provide battery/powered, two-speed clocks that are compatable with the all year double clock daylight saving system as defined in Pat. No. 4,763,311. issued to the present inventor on Aug. 9, 1988.

One more object of the invention is to provide battery/quartz powered time pieces that provide a means to include a computer with a memory chip to change for fast or slow time two times a year automatically as programmed.

In summary, the device of the present invention comprises a daylight savings clock including indicating means, such as rotatably driven hour and minute hands, for continuously indicating the passage of each period of twenty-four sequential periods; a first drive means for driving the indicating means for a first six month period at a rate such that the indicating means indicates the passage of each period of twenty four sequential periods in 3,602.5 seconds; and a second drive means for driving the indication means for a second six month period at a rate such that the indicating means indicates the passage of each of the twenty four sequential periods in 3,597.5 seconds.

In operation, beginning with the shortest day of the year on December 21 and continuing for six months, the first drive means drives the indicating means such as a hour hand at a fast time of 2½ seconds per hour. Then on the longest day of the year June 21 and continuing for six months the second drive means drives the indicating means at a slow time of 2½ seconds per hour thus completing the annual cycle.

In one form of the invention, the indicating means is provided in the form of a clock having either a twenty-four hour face or a standard twelve hour face, and rotatable minute and hour hands. In the preferred form of the invention the first and second drive means comprises a battery/quartz powered clock movement operably associated with the minute and hour hands.

Figure 1:
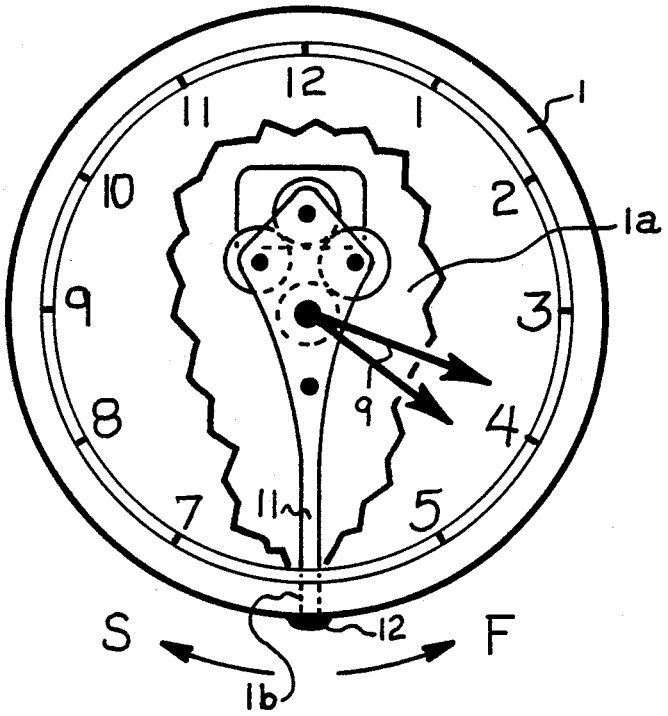
FIG. 1 is a preferred form of daylight saving clock 1 for fast and slow time having hour and minute hands. A lever 11 extends to the outside of a clock casing 1*a* through an opening 1*b* provided at a convenient location. A button 12 is provided for shifting to fast or slow time each six months.
Figure 2:
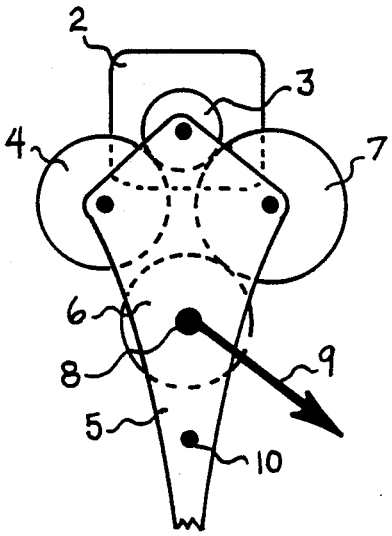
FIG. 2 shows the first and second drive means as a battery/quartz powered movement 2 which drives a drive gear 3 which is constantly meshed with the first and second gears 4 and 7. Gear 7 being larger in diameter drives gear 6 for fast time. Gear 4 being smaller in diameter drives gear 6 for slow time. Shifting between gears 4 and 7 is accomplished by a shift means which comprises button 12. Shaft 8 rotatably carries operating gear 6, which causes the minute and hour hands 9 of the indicating means to turn in a clockwise direction relative to the clock face. Lever 11 pivots about pivot point 10 to shift gears 4 and 7 for fast and slow time. In the drawing gear 3 shown in engagement with fast gear 7.
Figure 3:
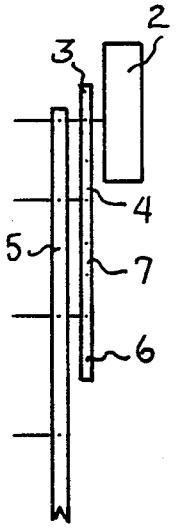
FIG. 3 is a side view, showing the battery/quartz powered movement 2 and gears 3, 4, 6 and 7 assembled to frame 5.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A clock for daylight saving, said clock being of a character having a quartz crystal which is used as a regulator for an electric oscillatory circuit, the output of which is supplied to a motor having a drive shaft, said clock comprising:

(a) a clock movement, including minute and hour hands and an operating gear for turning said minute and hour hands;

(b) A gear assembly cooperatively associated with said clock movement, including:

(i) a drive gear connected to the drive shaft of the motor of the clock;

(ii) a first driven gear of a first diameter in engagement with said drive gear; and (iii) a second driven gear of a second diameter in engagement with said drive gear;

said gear assembly being moveable from a first position wherein said operating gear is in engagement with said first driven gear to a second position wherein said operating gear is in engagement with said second driven gear; and (c) Shift means connected to said gear assembly for moving said gear assembly between said first and second positions.

2. A clock as defined in claim 1 which further includes a case for housing said clock movement and said shift means and in which said shift means comprises an elongated member having first and second ends, said gear assembly being mounted proximate said end thereof, said elongated member being pivotally connected to said case at a location intermediate said first and second ends of said elongated member.

3. A clock as defined in claim 2 in which said casing is provided with an opening and in which said second end of said elongated member extends through said casing.

4. A clock for daylight saving, said clock being of a character having a quartz crystal which is used as a regulator for an electric oscillatory circuit, the output of which is suppied to a motor having a drive shaft, said clock comprising:

(a) A hollow casing for housing the quartz crystal and motor, said hollow casing having an opening at the periphery thereof;

(b) A clock movement mounted within said casing, said movement including minute and hour hands and an operating gear for turning said hands;

(c) An elongated member pivotally connected to said casing for pivotal movement between first and second positions, said elongated member having first and second ends, said first end being disposed proximate said clock movement and said second end protruding through the opening in said hollow casing;

(d) A gear assembly connected to said elongated member proximate said first end thereof, said gear assembly comprising:

(i) a drive gear connected to the drive shaft of the motor of the clock;

(ii) a first driven gear of a first diameter in engagement with said drive gear; and (iii) a second driven gear of a second diameter in engagement with said drive gear;

Said first and second driven gears being located relative to said operating gear of said clock movement such that when said elongated member is in said first position said first driven gear is in engagement with said operating gear and when said elongated member is in said second position said second driven gear is in engagement with said operating gear.

5. A clock as defined in claim 4 in which said elongated member is moveable between said first and second positions by moving said second end thereof relative to said casing.

* * * * *